US005499012A

United States Patent [19]

Tracy et al.

[11] Patent Number: 5,499,012

[45] Date of Patent: Mar. 12, 1996

[54] INTRUSION DETECTOR TEST CIRCUIT WHICH AUTOMATICALLY DISABLES A DETECTED-EVENT INDICATOR

[75] Inventors: Lawrence Tracy, Auburn; Dale Dorando, Cameron Park; Frederick Eggers, Dixon, all of Calif.

[73] Assignee: C & K Systems, Inc., Calif.

[21] Appl. No.: 219,783

[22] Filed: Mar. 30, 1994

[51] Int. Cl.[6] ..... G08B 29/00

[52] U.S. Cl. ..... 340/514; 340/506; 340/539

[58] Field of Search ..... 340/514, 515, 340/506, 522, 539

[56] References Cited

U.S. PATENT DOCUMENTS

| | | | |
|---|---|---|---|
| 4,032,909 | 6/1977 | Boyce | 340/514 |
| 4,117,479 | 9/1978 | Galvin et al. | 340/506 |
| 4,138,674 | 2/1979 | Humphries | 340/514 |
| 4,412,211 | 10/1983 | Lautzenheiser et al. | 340/514 |
| 4,725,818 | 2/1988 | Motyka et al. | 340/514 |

OTHER PUBLICATIONS

GlassTrek 450/450S Paradox Instruction Manual from Pirotec Technologies, Quebec, Canada Jul. 1994.

*Primary Examiner*—Donnie L. Crosland

*Attorney, Agent, or Firm*—Limbach & Limbach; Alan S. Hodes

[57] ABSTRACT

An intrusion detector test circuit automatically disables a detected-event indicator from receiving sensing signals. A sensor generates a sensing signal in response to a detection of an installer testing the intrusion detector. An indictor means receives the sensing signals and generates detected-event indications in response to the sensing signals. A switch interposed between the sensor and the indicator receives the sensing signals. In a first state, the switch supplies the sensing signals to the indicator; in a second state, the switch means does not supply the sensing signals to the indicator. A first state setter sets the switch to the first state, and a second state setter automatically sets the switch to the second state after a lapse of a predetermined time period.

19 Claims, 4 Drawing Sheets

INTRUSION DETECTOR TEST CIRCUIT WHICH AUTOMATICALLY DISABLES A DETECTED-EVENT INDICATOR

TECHNICAL FIELD OF THE INVENTION

The present invention relates to a sensor test circuit, and in particular, to a sensor test circuit which disables a detected-event indicator responsive to a lapse of a predetermined time period.

BACKGROUND OF THE INVENTION

An intrusion detector is a device which generates an alarm signal when the detector detects unauthorized activity in or around a protected volume of space. The detector has one or more sensors which may be, for example, a motion sensor or a glass-break sensor.

After an installer installs the detector, the installer "walk-tests" the detector to ensure that it is functioning properly. To walk-test a motion sensor, for example, the installer walks throughout the motion sensor's field of view to cause the generation of a sensing signal. In response to the sensing signal, a detected-event indicator such as an LED may be illuminated. To perform the walk-test, the installer may be required to first enable the detected-event indicator, which is conventionally done by opening the housing of the detector and installing a jumper.

After walk testing the detector, it is desirable that the installer disable the detected-event indicator from being responsive to the sensing signals generated by the sensors. This is desirable because if the detector is battery-operated, repeated activation of the detected-event indicator greatly reduces the life of the battery. Furthermore, activation of the detected-event indicator during normal operation of the sensor may alert an intruder that he has been detected.

With a conventional detector, after walk-testing the sensor the installer must manually disable the detected-event indicator. The installer may forget to disable the detected-event indicator.

Furthermore, if the detected-event indicator is enabled by opening the sensor housing and installing a jumper, the installer must reopen the cover of the motion detector housing and remove the jumper. The installer may disturb the sensor while removing the jumper or while opening or closing the cover, thus invalidating the walk-test.

SUMMARY OF THE INVENTION

The present invention is an intrusion detector test circuit which automatically disables a detected-event indicator from receiving sensing signals.

In accordance with a first embodiment of the present invention, the intrusion detector test circuit comprises sensing means for generating a sensing signal in response to a detection of an installer testing the intrusion detector. The intrusion detector further comprises indicating means for receiving the sensing signals and for generating detected-event indications in response to the sensing signals.

Switch means interposed between the sensing means and the indicating means is for receiving the sensing signals. In a first state, the switch means supplies the sensing signals to the indicating means; in a second state, the switch means does not supply the sensing signals to the indicating means.

First state setting means is for setting the switch means to the first state, and second state setting means is for automatically setting the switch means to the second state after a lapse of a predetermined time period.

In accordance with a further embodiment of the present invention, the intrusion detector test circuit further comprises lockout control means for disabling a lockout circuit when the lockout control means is in a first state and for automatically enabling the lockout circuit when the lockout control means is in a second state. The first state setting means may set the lockout control means to the first state and the second state setting means may automatically set the lockout control means to the second state after the lapse of the a predetermined time period.

A better understanding of the features and advantages of the invention will be obtained by reference to the following detailed description and accompanying drawings which set forth an illustrative embodiment in which the principles of the invention are utilized.

DETAILED DESCRIPTION OF THE INVENTION

Figure 1:
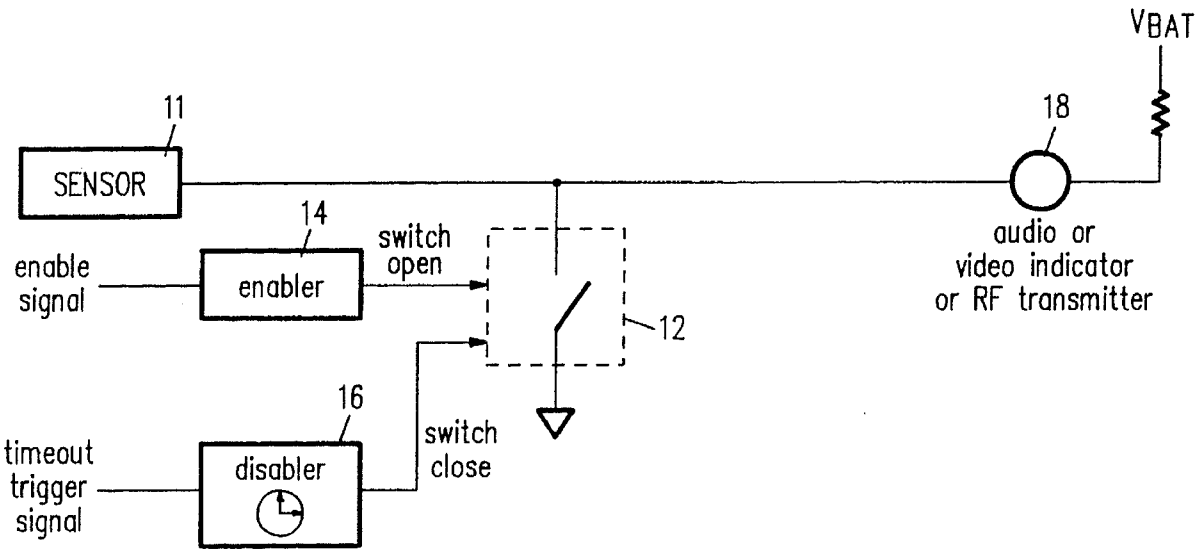
FIG. 1 is a block diagram of an intrusion detector test circuit in accordance with a first embodiment of the present invention.

FIG. 1 is a block diagram of an intrusion detector test circuit 10 in accordance with a first embodiment of the present invention. Sensor events, in the form of sensing signals, are presented to the a detected-event indicator 18 from a sensor 11. The sensor 11 generates a sensing signal in response to the sensing of an intruder in a volume of space, based upon well-known principles. The sensor 11 can be, for example, a PIR sensor, responsive to infrared radiation generated by an intruder, or a microwave sensor, responsive to the motion of an intruder in a volume of space. Sensor are typically contained within a housing.

A switch 12 is interposed between the sensor 11 and the detected-event indicator 18. In the preferred embodiment, the switch 12 and the detected-event indicator both receive the sensing signal simultaneously. The switch 12, when in the CLOSED position, disables the detected-event indicator 18 from receiving the sensing signal by grounding the sensing signal. When the switch 12 is in the OPEN position, the sensing signal is no longer grounded and the detected-event indicator 18 is enabled to receive the sensing signal from the sensor 11. Put simply, the detected-event indicator 18 provides an indication of a sensor event, but only when the detected-event indicator 18 is enabled. Alternatively, the switch 12 can be physically interposed between the sensor 11 and the detected-event indicator 18.

The detected-event indicator 18 may be, for example, a visual indicator such as an LED. As a further example, the detected-event indicator 18 may be an audio indicator such as a buzzer or beeper. As a still further example, the detected-event indicator 18 may be an RF transmitter that generates an event indication by transmitting an RF signal.

The detected-event indicator 18 is enabled (i.e. the switch 12 is set to the OPEN position) by an enabler 14, which applies a "switch open" signal to the switch 12, in response to an enable signal presented to the enabler 14. The detected-event indicator 18 is disabled (i.e. the switch 12 is set to the CLOSED position) by a disabler 16, which automatically applies a "switch close" signal to the switch 12, in response to a lapse of a predetermined time period. The a predetermined time period begins when the disabler 16 receives a timeout trigger signal.

To test the intrusion detector, the installer first enables the detected-event indicator 18 by causing an enable signal to be sent to the enabler 14. This may be done, for example, by depressing an enable button on the sensor housing (not shown) or installing a jumper. Then, the installer causes sensor events and checks that the sensor events are indicated by the detected-event indicator 18. For example, if the sensor is a motion detector, the installer may cause sensor events by moving about within the motion detector field of view. As a further example, if the sensor is a glass-break detector, the installer may walk-test the sensor by breaking glass or by simulating the sound of breaking glass. Thus, if the sensor is a motion detector and the motion detector is functioning properly during the walk-test, sensor events will occur in response to the installer's motion and the detected-event indicator 18 will indicate the sensor events.

The detected-event indicator 18 is disabled from receiving sensing signals by the disabler 16, without intervention from the installer, after a lapse of a predetermined time period. The time period begins when a timeout trigger signal is received by the disabler 16. The timeout trigger signal may occur, for example, in response to the installer depressing a disable button on or within the sensor.

It may be preferable, however, for the event that causes the enable signal to be the same event that causes the timeout trigger signal. That is, if the sensor installer causes an enable signal to be sent to the enabler 14 by depressing a button on the sensor housing, the same depression of the button would also cause a timeout trigger signal to be sent to the disabler 16. In fact, the enable signal may be one in the same signal as the timeout trigger signal, offering the advantage that the detected-event indicator 18 is disabled without relying on the installer to remember to trigger the timeout.

Figure 2:
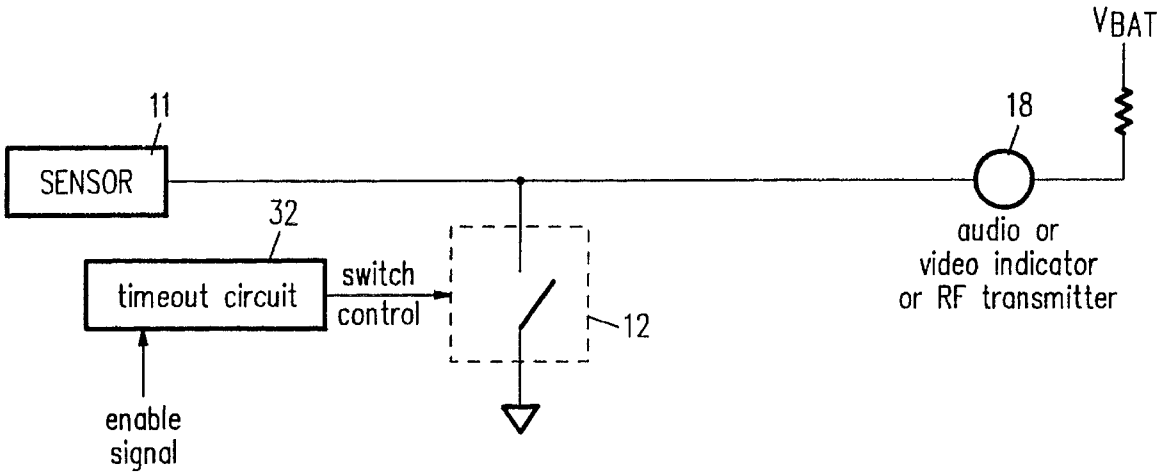
FIG. 2 is a block diagram of an intrusion detector test circuit in accordance with a second embodiment of the present invention.

FIG. 2 is a block diagram of an intrusion detector test circuit 30 in accordance with a second embodiment of the present invention. Where the various components are the same as in FIG. 1, the same reference numerals are used. As with the intrusion detector test circuit 10 shown in FIG. 1, sensing signals are presented to the detected-event indicator 18 from the sensor 11. When the switch 12 is in the OPEN position, the detected-event indicator 18 is enabled to receive the sensing signals, and when the switch 12 is in the CLOSED position, the detected-event indicator 18 is disabled from receiving the sensing signals.

In the second embodiment, a timeout circuit 32 both enables and disables the detected-event indicator, setting the switch 12 to the OPEN and CLOSED positions, respectively, by applying a "switch control" signal to the switch 12. That is, the timeout circuit 32 effectively combines the functions of the enabler 14 and the disabler 16 of the first embodiment.

As with the first embodiment, it may be preferable for the event that causes the enable signal to be the same event that causes the timeout trigger signal, or for the enable signal to be one in the same signal as the timeout trigger signal, so that the detected-event indicator 18 is disabled without relying on the installer to remember to trigger the timeout.

Figure 3:
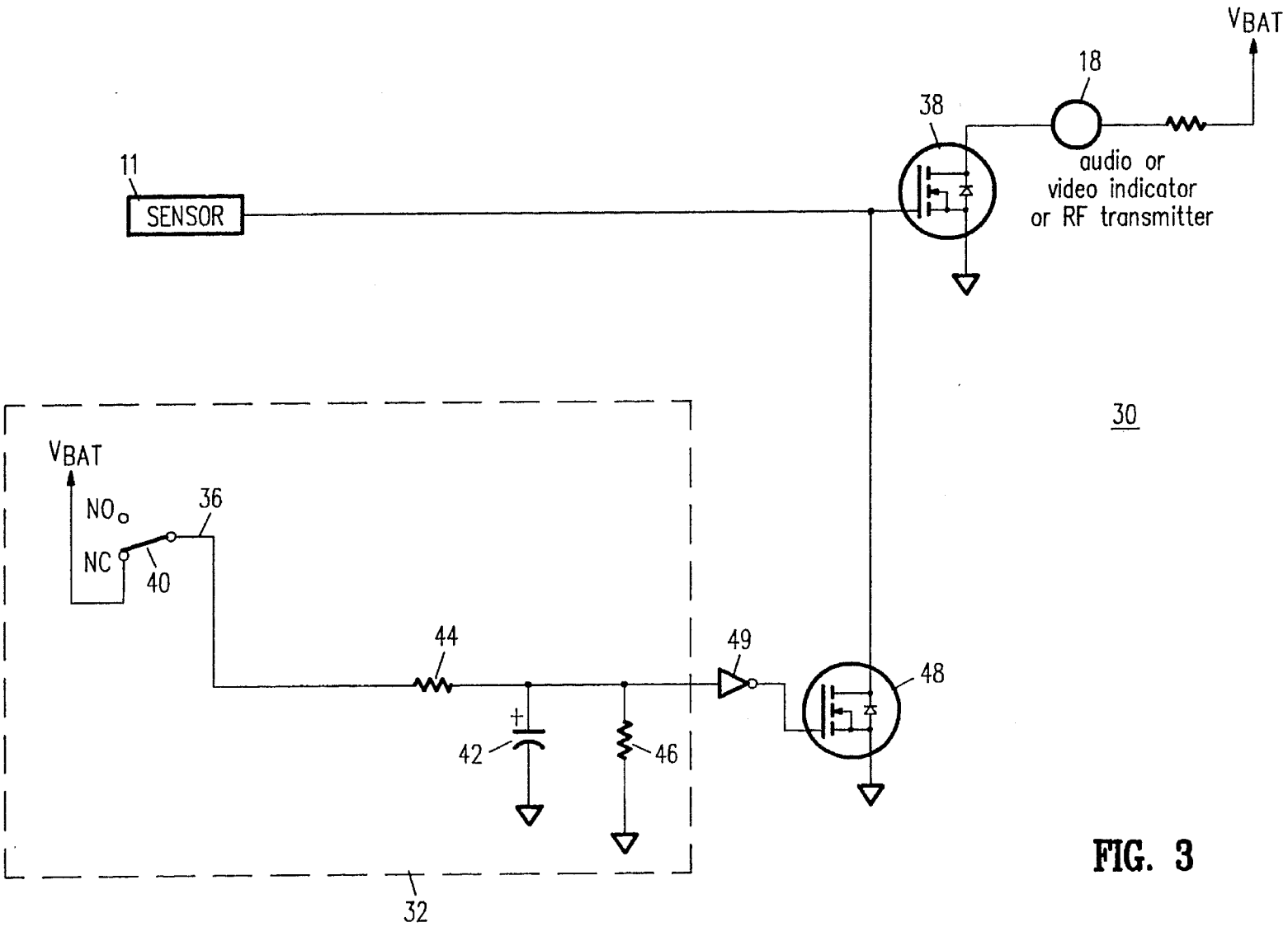
FIG. 3 is a detailed schematic of the intrusion detector test circuit of FIG. 2.

FIG. 3 shows a detailed schematic of a possible implementation of the second embodiment. Again, where the various components are the same as in the other figures, the same reference numerals are used.

Sensor events are presented to the detected-event indicator 18 from the sensor 11 in the form of pulsed-high sensing signals. The sensing signals are presented to the gate input of a field-effect transistor 38, and the anode output of the field-effect transistor 38 is connected to the detected-event indicator 18.

The "switch control" signal from the timeout circuit 32 is presented to the gate input of a field-effect transistor 48. When the "switch control" signal is high (i.e. above the threshold voltage of the field-effect transistor 48), the field-effect transistor 48 is shorted to ground, keeping the field-effect transistor 38 off, and thus disabling the detected-event indicator 18. That is, when the "switch control" signal is high, sensing signals cannot be received by the detected-event indicator 18 to indicate a sensor event.

By contrast, when the "switch control" signal is low (i.e. below the threshold voltage of the field-effect transistor 48), sensing signals presented to the detected-event indicator 18 will turn on the field-effect transistor 38. This will turn on the detected-event indicator 18 to indicate to the installer that a sensor event has occurred.

Thus, the field-effect transistor 48 functions as the switch 12 of FIG. 2. Put simply, the state of the "switch control" output of the timeout circuit 32 determines the enabled/disabled state of the detected-event indicator 18.

The timeout circuit 32 comprises a switch 40, which can be in one of two switch positions, NO and NC. When the switch 40 is in the NO position, the output 36 of the switch 40 is isolated from the input of the switch 40. When the switch 40 is in the NC position the output 36 of the switch 40 is connected to $V_{bat}$. FIG. 3 shows the switch 40 in the NC position.

Looking now at the situation when the switch 40 is first switched from the NO position to the NC position, this connects a capacitor 42 to $V_{bat}$ through a resistor 44, thus charging the capacitor 42. The resistor 44 is not required for charging the capacitor 42. However, the resistor 44, if present, limits the "surge" current to the capacitor 42 to a safe level. Once the voltage across the capacitor 42, when inverted by an inverter 49, goes below the threshold voltage of the field-effect transistor 48, the detected-event indicator 18 is enabled.

When the switch 40 is switched back to the NO position, the capacitor 42 discharges through a resistor 46. The rate of discharging of the capacitor 42 is dependent on the time constant of the resistor/capacitor pair.

While the voltage across the capacitor 42, inverted by the inverter 49, remains below the threshold voltage of the field-effect transistor 48, the detected-event indicator 18 remains enabled. However, once the voltage on the capacitor 42, inverted by the inverter 49, rises above the threshold voltage of field-effect transistor 48, the detected-event indicator 18 is once again disabled. Thus, the detected-event indicator 18 is disabled after the lapse of a predetermined time period, the predetermined time period being determined by the rate of discharging of the capacitor 42 through the resistor 46.

Some intrusion detectors have a lockout feature, well-known in the art, which in normal operation of the intrusion detector prevents additional sensor events, within a specified time of a first sensor event, from causing multiple alarms. For example, referring to FIG. 4, a lockout signal LOCK-OUT may be an input to a microprocessor 62, where the lockout input of the microprocessor has an internal pull-up so that its default undriven state is high. When the lockout input of the microprocessor is high, firmware in the microprocessor enables the lockout feature.

Figure 4:
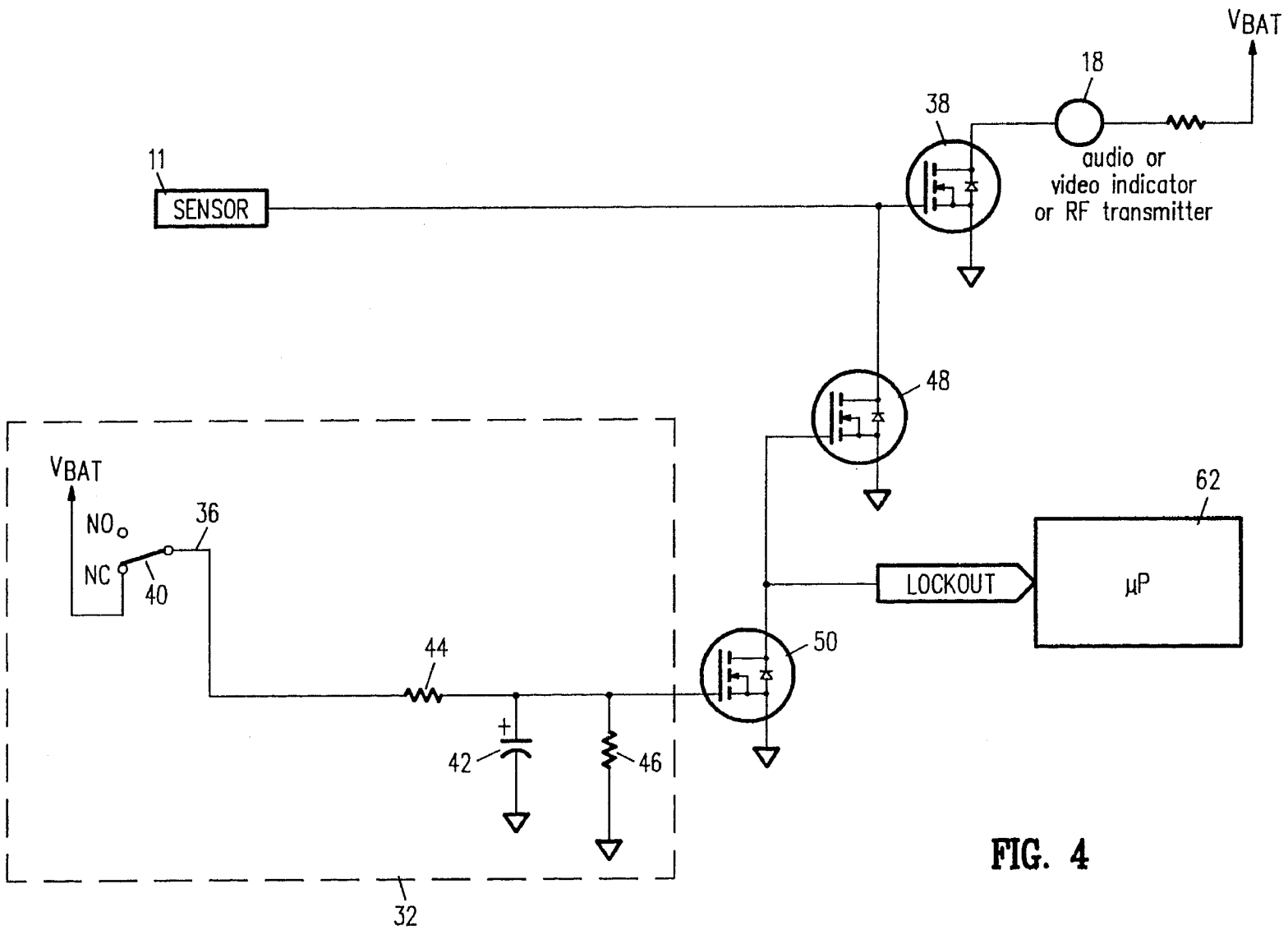
FIG. 4 is the detailed schematic of FIG. 3, but with additional circuitry for enabling and disabling a lockout feature.

Since the lockout feature blocks out repeated sensor events, in order to effectively test an intrusion detector having a lockout feature, the lockout feature must be disabled. FIG. 4 shows a mechanism, in accordance with the present invention, for disabling the lockout feature.

Referring to FIG. 4, a field-effect transistor 50 replaces, and performs the function of, the inverter 49 of FIG. 3. The anode of the field-effect transistor 50 is connected to the lockout input of the microprocessor and to the gate input of the field-effect transistor 48.

When the timeout circuit 32 output level is below the threshold voltage of the field-effect transistor 50, the field-effect transistor 50 remains off. When the field-effect transistor 50 is off, the lockout input to the microprocessor is in its default state, pulled up by its internal pull-up, and the lockout feature is thus enabled in the microprocessor firmware.

The internal pull-up of the microprocessor lockout input pulls the gate of the field-effect transistor 48 high, shorting the anode of the field-effect transistor 48 to ground. This in turn keeps the field-effect transistor 38 off, disabling the detected-event indicator 18.

On the other hand, when the output of the timeout circuit 32 is above the threshold voltage of field-effect transistor 50, the field-effect transistor 50 turns on. This shorts the microprocessor lockout input to ground, thus disabling the lockout feature in the microprocessor firmware.

While the microprocessor lockout input is shorted to ground, the field-effect transistor 48 is off, and while the field-effect transistor 48 is off, the detected-event indicator 18 is enabled. That is, a sensor event signal transmitted to the field-effect transistor 38 will turn on the field-effect transistor 38, so that the detected-event indicator 18 will indicate to the installer that a sensor event has occurred.

Figure 5:
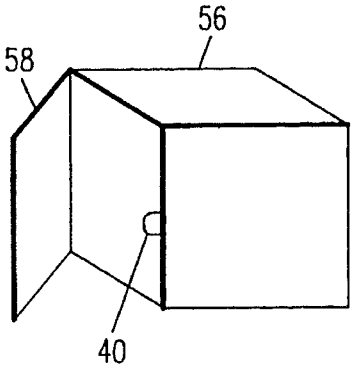
FIG. 5 is a diagram of a housing for the intrusion detector that includes a tamper feature.

As discussed above, the switch 40 may be switched to position NC by, for example, depressing a button on the sensor. However, many intrusion detectors have a "tamper" feature. That is, as shown in FIG. 5, the intrusion detector is housed within a housing 56, and the housing has a cover 58. Opening the cover of an intrusion detector which has a tamper feature actuates a tamper switch 40 from a normal position, and closing the cover actuates the tamper switch 40 back to the normal position. In normal operation of the sensor, actuation of the tamper switch 60 causes a tamper signal to be generated. As discussed below, actuation of the tamper switch 40 may also provide a convenient way to cause the enable and timeout trigger signals for operation of an intrusion detector test circuit. That is, the tamper switch 40 may serve the dual purpose of triggering a tamper signal when the sensor has been tampered with during normal operation, and enabling and disabling the detected-event sensor 18 of the intrusion detector test circuit 30.

Figure 6:
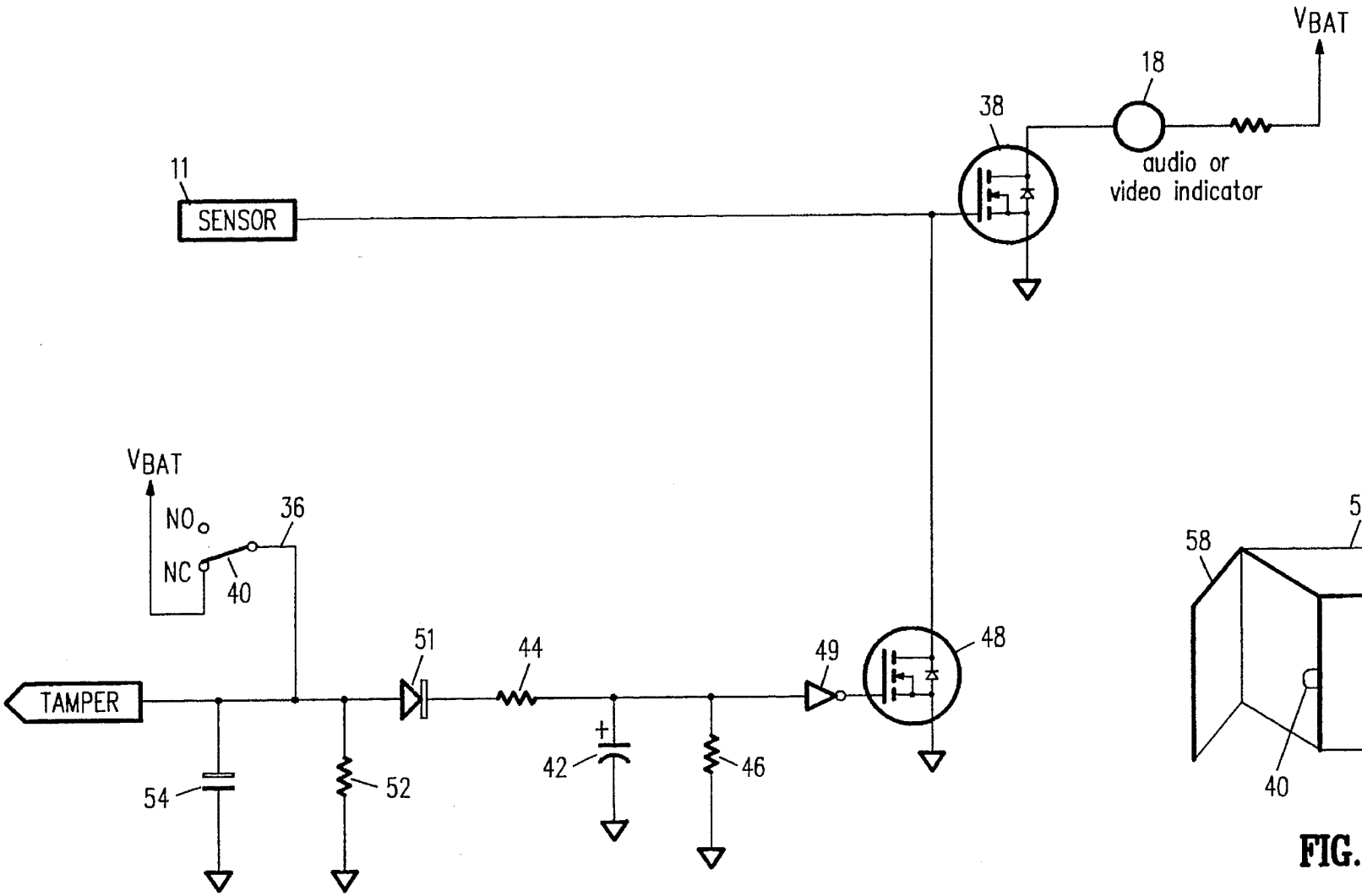
FIG. 6 is the detailed schematic of FIG. 3, but with additional circuitry for interfacing to a tamper circuit.

Such a dual-purpose tamper switch configuration is shown in FIG. 6. When the sensor housing cover is opened, tamper switch 40 moves to position NC, connecting the anode of a diode 51 to $V_{bat}$. This forward biases the diode 51, thus allowing the capacitor 42 to charge.

When the sensor housing cover is then closed, the switch 40 returns to its initial position NO, allowing the capacitor 54 to discharge through a resistor 52, and allowing the capacitor 42 to discharge through the resistor 46.

In order to isolate the walk-test circuit from normal tamper operation, the capacitor 54, the resistor 52, the capacitor 42, and the resistor 44 should be chosen such that the capacitor 54 discharges faster than the capacitor 42, to cause a reverse bias voltage across the diode 51. The reverse bias voltage across the diode 51 turns off the diode 51 to isolate the intrusion detector test circuit from the normal tamper operation.

What is claimed is:

1. An intrusion detector test circuit for testing an intrusion detector, comprising:

sensing means for generating a sensing signal in response to a detection of an installer testing the intrusion detector;

indicating means for receiving said sensing signal and for generating a detected-event indication in response thereto;

switch means interposed between said sensing means and said indicating means for receiving said sensing signal and, in a first state, for supplying said sensing signal to said indicating means, and, in a second state, for not supplying said sensing signal to said indicating means;

first state setting means for setting said switch means to said first state; and second state setting means for automatically setting said switch means to said second state after a lapse of a predetermined time period.

2. An intrusion detector test circuit as in claim 1, wherein said indicating means is a visual indicator.

3. An intrusion detector test circuit as in claim 1, wherein said indicating means is an audio indicator.

4. An intrusion detector test circuit as in claim 1, wherein said indicating means is a RF transmitter that generates an event indication by transmitting an RF signal.

5. An intrusion detector test circuit as in claim 1, wherein said first state setting means sets said switch means to said first state by applying a first switch state control signal to said switch means.

6. An intrusion detector test circuit as in claim 5, wherein said a predetermined time period begins responsive to a timeout trigger signal.

7. An intrusion detector test circuit as in claim 6, wherein said second state setting means sets said switch means to said second state by applying a second switch state control signal to said switch means.

8. An intrusion detector test circuit as in claim 6, wherein said first switch state control signal is said timeout trigger signal.

9. An intrusion detector test circuit as in claim 6, wherein the intrusion detector is housed within a housing and said intrusion detector test circuit further comprises:

a tamper switch means operable in two modes, actuated when said housing is removed and deactuated when said housing is replaced, wherein in a first mode actuating said tamper switch causes said intrusion detector to generate an alarm, and wherein in a second mode actuating said tamper switch causes said first state setting means to apply said first switch state control signal to said switch means.

10. An intrusion detector test circuit as in claim 9, wherein deactuating said tamper switch when said intrusion detector is in said second mode causes said timeout trigger signal.

11. An intrusion detector test circuit as in claim 1, further comprising:

lockout control means for disabling a lockout circuit when said lockout control means is in a first state and for automatically enabling the lockout circuit when said lockout control means is in a second state wherein said first state setting means sets said lockout control means to said first state and said second state setting means automatically sets said lockout control means to said second state after said lapse of said a predetermined time period.

12. An intrusion detector test circuit for testing an intrusion detector, comprising:

sensing means for generating a sensing signal in response to a detection of an installer testing the intrusion detector;

indicating means for receiving said sensing signal and for generating a detected-event indication in response thereto;

switch means interposed between said sensing means and said indicating means for receiving said sensing signal and, in a first state, for supplying said sensing signal to said indicating means, and, in a second state, for not supplying said sensing signal to said indicating means; and timer circuit means for setting said switch means to said first state and for setting said switch means to said second state automatically after a lapse of an predetermined time period, after said switch means is in said first state.

13. An intrusion detector test circuit as in claim 12, wherein said timer circuit means comprises a capacitor, a first terminal of said capacitor switchably connected to a voltage source and a second terminal of said capacitor connected to ground, and a first resistor connected between said first terminal of said capacitor and ground, said first terminal of said first capacitor connected to said switch means whereby said timer circuit means applies a voltage at said first terminal of said capacitor to said switch means, for setting said switch means to said first state upon said first terminal of said capacitor being connected to said voltage source, and for setting said switch means to said second state, after said first terminal of said capacitor being switchably disconnected from said voltage source, and the voltage at said first terminal of said capacitor being discharged through said first resistor, after said predetermined time period, said predetermined time period being determined by a resistance of said first resistor and a capacitance of said capacitor.

14. An intrusion detector test circuit as in claim 13, wherein said timer circuit means further comprises a second resistor interposed between said first terminal of said capacitor and said switchably connected voltage source whereby said timer circuit means applies a voltage at said first terminal of said capacitor to said switch means, for setting said switch means to said first state upon said first terminal of said capacitor being connected to said voltage source through said second resistor, after a time period determined by a resistance of said second resistor and said capacitance of said capacitor.

15. An intrusion detector test circuit for testing an intrusion detector, the intrusion detector being housed within a housing and having a sensing means for generating a sensing signal in response to a detection of an installer testing the intrusion detector, said intrusion detector test circuit comprising:

indicating means for receiving said sensing signal and for generating a detected-event indication in response thereto;

switch means interposed between said sensing means and said indicating means for receiving said sensing signal and, in a first state, for supplying said sensing signal to said indicating means, and, in a second state, for not supplying said sensing signal to said indicating means;

first state setting means for setting said switch means to said first state by applying a first switch state control signal to said switch means; and second state setting means for automatically setting said switch means to said second state after a lapse of a predetermined time period by applying a second switch control signal after said lapse of said predetermined time period; and tamper switch means operable in two modes, actuated when said housing is removed and aleactuated when said housing is replaced, wherein in a first mode actuating said tamper switch causes said intrusion detector to generate an alarm, and wherein in a second mode actuating said tamper switch causes said first state setting means to apply said first switch state control signal to said switch means.

16. An intrusion detector test circuit as in claim 15, wherein said a predetermined time period begins responsive to a timeout trigger signal.

17. An intrusion detector test circuit as in claim 16, wherein said first switch state control signal is said timeout trigger signal.

18. An intrusion detector test circuit as in claim 16, wherein deactuating said tamper switch causes said timeout trigger signal to be generated.

19. An intrusion detector test circuit as in claim 15, further comprising:

lockout control means for disabling a lockout circuit when said lockout control means is in a first state and for automatically enabling the lockout circuit when said lockout control means is in a second state wherein said first state setting means sets said lockout control means to said first state and said second state setting means automatically sets said lockout control means to said second state after said lapse of said predetermined time period.

* * * * *